US008955227B2

(12) United States Patent
Lee

(10) Patent No.: US 8,955,227 B2
(45) Date of Patent: Feb. 17, 2015

(54) CAN OPENER

(76) Inventor: Hui-Ling Lee, Caotun Township, Nantou County (TW)

( * ) Notice: Subject to any disclaimer, the term of this patent is extended or adjusted under 35 U.S.C. 154(b) by 292 days.

(21) Appl. No.: 13/602,280

(22) Filed: Sep. 3, 2012

(65) Prior Publication Data

US 2014/0059869 A1 Mar. 6, 2014

(51) Int. Cl.
*B67B 7/72* (2006.01)

(52) U.S. Cl.
USPC ..... 30/416; 30/417; 30/426; 30/427

(58) Field of Classification Search
CPC ..... B67B 7/30; B67B 2007/303; B67B 7/32; B67B 7/34; B67B 7/38; B67B 7/385
USPC ..... 30/403, 410, 416, 417, 424–427; D8/36
See application file for complete search history.

(56) References Cited

U.S. PATENT DOCUMENTS

| | | | | | |
|---|---|---|---|---|---|
| 2,883,745 | A | | 4/1959 | Bristol | |
| 3,126,627 | A | | 3/1964 | Freedman et al. | |
| 3,142,902 | A | | 8/1964 | Tone et al. | |
| 3,768,159 | A | | 10/1973 | Emmons et al. | |
| 3,791,029 | A | | 2/1974 | Yamamoto | |
| 4,207,676 | A | | 6/1980 | Okumura | |
| 4,622,749 | A | * | 11/1986 | Inagaki | 30/421 |
| 4,702,007 | A | * | 10/1987 | Nomura et al. | 30/419 |
| 4,734,985 | A | * | 4/1988 | Ozaki | 30/404 |
| D421,205 | S | * | 2/2000 | Naft et al. | D8/36 |
| D444,686 | S | * | 7/2001 | Brady | D8/36 |
| D452,421 | S | * | 12/2001 | DeMore et al. | D8/36 |
| 6,516,524 | B1 | * | 2/2003 | Brady | 30/423 |
| 6,886,260 | B1 | * | 5/2005 | Lee | 30/423 |
| 7,213,340 | B1 | * | 5/2007 | Lee | 30/416 |
| D561,547 | S | * | 2/2008 | Lee | D8/36 |
| 7,437,825 | B2 | * | 10/2008 | Sanders et al. | 30/417 |
| D594,301 | S | * | 6/2009 | Mah et al. | D8/36 |
| 8,371,033 | B2 | * | 2/2013 | Cantore et al. | 30/425 |
| 8,443,518 | B2 | * | 5/2013 | Fisher | 30/2 |
| 2002/0148122 | A1 | * | 10/2002 | Sanchez et al. | 30/426 |
| 2012/0047753 | A1 | * | 3/2012 | Mah et al. | 30/427 |
| 2013/0133211 | A1 | * | 5/2013 | Cantore et al. | 30/410 |

FOREIGN PATENT DOCUMENTS

| | | | | |
|---|---|---|---|---|
| CA | 2529680 | A1 | * | 4/2007 |
| DE | 202013101514 | U1 | * | 4/2013 |
| EP | 1775256 | A1 | * | 4/2007 |
| EP | 1972596 | A1 | * | 9/2008 |
| EP | 2423156 | B1 | * | 6/2013 |

(Continued)

*Primary Examiner* — Jason Daniel Prone
(74) *Attorney, Agent, or Firm* — Alan D. Kamrath; Kamrath IP Lawfirm, P.A.

(57) ABSTRACT

A can opener includes a housing, a driving gear, a reduction transmission device, a cutting wheel, a slide, an idling wheel, a first driven gear, a second driven gear, a torsion spring, a third driven gear, and a cam. The driving gear rotates the cutting wheel and the first driven gear. The first driven gear drives the second driven gear which rotates the third driven gear which rotates the cam which moves the slide which moves the idling wheel, so that the idling wheel is moved toward the cutting wheel to clamp the rim of the lid between the idling wheel and the cutting wheel. The idling wheel and the cutting wheel are moved along the rim of the lid to cut the rim of the lid and to separate the lid from the can to open the can automatically.

6 Claims, 5 Drawing Sheets

(56) References Cited

FOREIGN PATENT DOCUMENTS

| | | | |
|---|---|---|---|
| GB | 2431389 A | * | 4/2007 |
| GB | 2453615 A | * | 4/2009 |
| GB | 2455518 A | * | 6/2009 |
| WO | WO 2012024248 A1 | * | 2/2012 |

* cited by examiner

CAN OPENER

BACKGROUND OF THE INVENTION

1. Field of the Invention

The present invention relates to an opening tool and, more particularly, to an opener for opening the lid of a container, such as a can and the like.

2. Description of the Related Art

A conventional can opener comprises a handle, and a cutter mounted on the handle. The cutter has a side provided with a resting portion and a blade. When in use, the cutter of the can opener is placed on the lid of a can, with the resting portion of the cutter abutting the outer rim of the lid, and with the blade of the cutter abutting the inner rim of the lid. When the handle of the can opener is rotated by the user, the blade of the cutter penetrates the lid of the can to form a hole in the surface of the lid. Then, the handle of the can opener is rotated successively, and the blade of the cutter is moved along the inner rim of the lid to perform a circular motion to form an elongate groove in the surface of the lid. After the blade of the cutter finishes its circular motion, an endless groove is formed in the surface of the lid to separate the lid from the can so that the lid can be removed from the can, thereby opening the can. However, the user has to apply a larger force on the handle of the can opener to rotate the handle of the can opener relative to the can, thereby wasting the user's energy. In addition, the user's one hand has to hold the can, and his other hand has to hold the can opener to open the can, thereby causing inconvenience to the user.

Prior art references were disclosed in U.S. Pat. No. 2,883,745, U.S. Pat. No. 3,126,627, U.S. Pat. No. 3,142,902, U.S. Pat. No. 3,768,159, U.S. Pat. No. 3,791,029, and U.S. Pat. No. 4,207,676.

BRIEF SUMMARY OF THE INVENTION

In accordance with the present invention, there is provided a can opener, comprising a housing having an interior provided with a mounting seat, a driving gear rotatably mounted on the mounting seat of the housing, a reduction transmission device mounted in the housing and connected with the driving gear to drive the driving gear, a cutting wheel rotatably mounted on the housing and rotated in concert with the driving gear, a slide movably mounted on the mounting seat of the housing and having a surface provided with an aperture, a washer secured on a bottom of the slide to move in concert with the slide, an idling wheel rotatably mounted on the washer and movable relative to the cutting wheel, a first driven gear rotatably mounted in the housing and meshing with the driving gear, a second driven gear rotatably mounted in the housing, a torsion spring biased between the first driven gear and the second driven gear to connect the first driven gear and the second driven gear, a third driven gear rotatably mounted in the housing and meshing with the second driven gear, and a cam mounted on and rotated by the third driven gear and received in the aperture of the slide to move the slide relative to the cutting wheel. The second driven gear has a surface provided with an arcuate guiding slot. The first driven gear has a surface provided with a protrusion mounted in the guiding slot of the second driven gear. Thus, when the first driven gear is rotated by the driving gear, the protrusion of the first driven gear is movable in the guiding slot of the second driven gear to drive and rotate the second driven gear and to compress the torsion spring, so that the torsion spring stores a restoring force.

According to the primary advantage of the present invention, the can opener separates the lid from the can to open the can automatically to save the user's energy, so that the user needs not to apply any force to open the can.

According to another advantage of the present invention, the can opener is revolved along the rim of the lid to separate the lid from the can and stops operating when the lid is separated from the can, so that the user does not need to hold the can and the can opener during the opening process, thereby facilitating the user operating the can opener to open the can.

According to a further advantage of the present invention, the lid is directly separated from the can after the can opener finishes a circular motion, so that the can is opened easily and quickly.

According to a further advantage of the present invention, the rim of the lid is cut by the cutting wheel smoothly without producing sharp burs, so that the rim of the lid will not cut the user after the lid is removed from the can to protect the user's safety.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
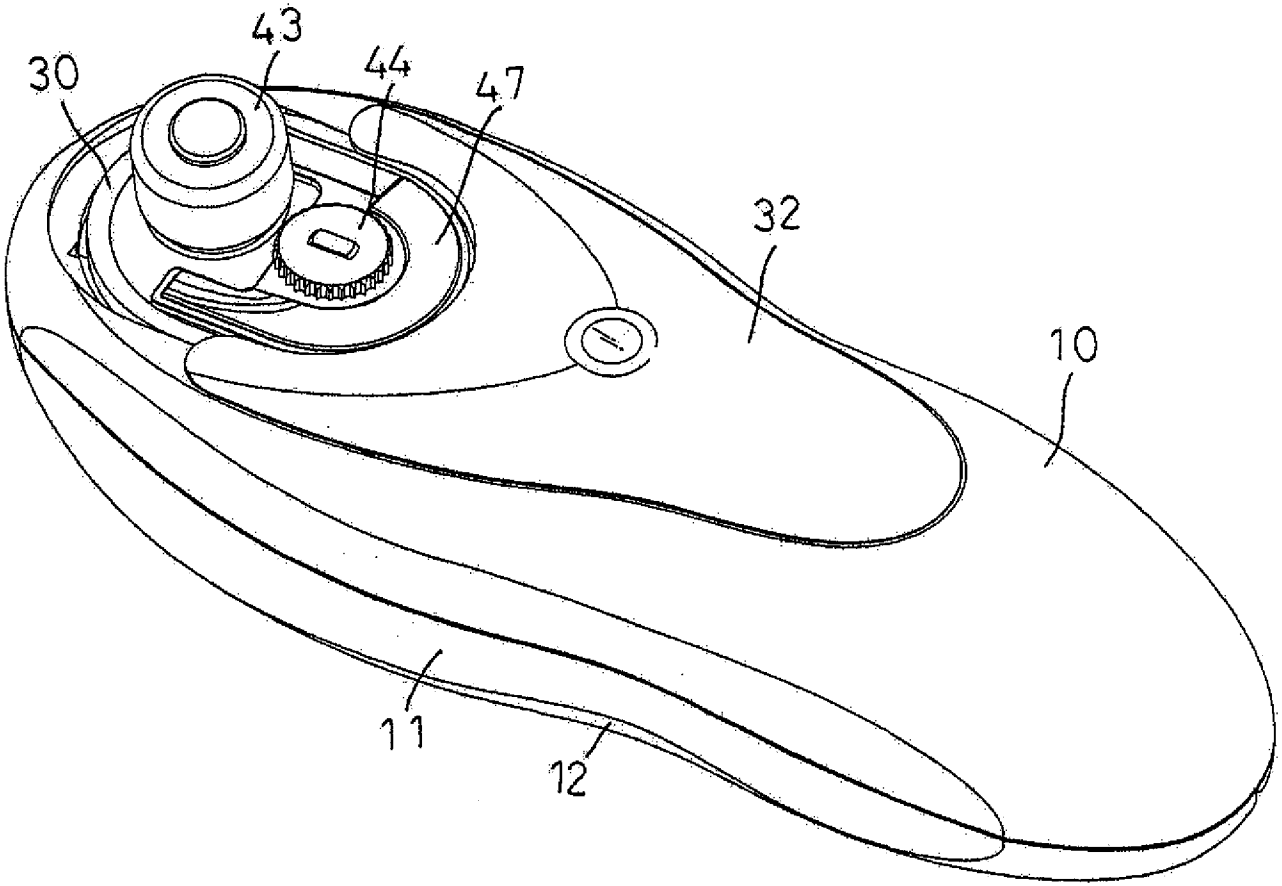
FIG. 1 is a perspective bottom view of a can opener in accordance with the preferred embodiment of the present invention.

Referring to FIGS. 1-5, a can opener in accordance with the preferred embodiment of the present invention comprises a housing 10 having an interior provided with a mounting seat 14, a driving gear 20 rotatably mounted on the mounting seat 14 of the housing 10, a reduction transmission device 2 mounted in the housing 10 and connected with the driving gear 20 to drive the driving gear 20, a cutting wheel 44 rotatably mounted relative to the housing 10 and rotated in concert with the driving gear 20, a driving shaft 21 rotatably mounted in the housing 10 and having a first end connected with the driving gear 20 and a second end connected with the cutting wheel 44, a microswitch 18 mounted on the mounting seat 14 of the housing 10, a slide 30 movably mounted on the mounting seat 14 of the housing 10 and having a surface provided with an aperture 36, a washer 46 secured on a bottom of the slide 30 to move in concert with the slide 30, a metallic plate 47 mounted on the driving shaft 21 and disposed between the washer 46 and the cutting wheel 44, a stop plate 32 mounted on the housing 10 and abutting the bottom of the slide 30 to attach the slide 30 to the housing 10 for movement, an idling wheel 43 rotatably mounted on the washer 46 and movable relative to the cutting wheel 44, a first driven gear 60 rotatably mounted in the housing 10 and meshing with the driving gear 20, a second driven gear 70 rotatably mounted in the housing 10, a torsion spring 64 biased between the first driven gear 60 and the second driven gear 70 to connect the first driven gear 60 and the second driven gear 70, a spindle 61 mounted in the housing 10 and extended through the first driven gear 60 and the second driven gear 70 to support the first driven gear 60 and the second driven gear 70, a third driven gear 50 rotatably mounted in the housing 10 and meshing with the second driven gear 70, a follower 40 mounted between the third driven gear 50 and the slide 30 to move in concert with the slide 30, and a cam 52 mounted on and rotated by the third driven gear 50 and received in the aperture 36 of the slide 30 to move the slide 30 relative to the cutting wheel 44.

The mounting seat 14 of the housing 10 has an interior provided with a receiving chamber 15 for mounting the third driven gear 50, the follower 40 and the slide 30. The receiving chamber 15 of the mounting seat 14 has a sidewall provided with an opening 16. The mounting seat 14 of the housing 10 has a surface provided with an elongate recess 17.

The reduction transmission device 2 includes a plurality of intermeshing reduction gears 22 and 23. One intermeshing reduction gear 23 meshes with the driving gear 20 to drive the driving gear 20, and a drive motor 24 is connected with the reduction gear 22 to drive the reduction gear 22. The drive motor 24 of the reduction transmission device 2 has a side provided with a worm 25 meshing with the reduction gear 22 to drive the reduction gear 22. Each of the reduction gears 22 and 23 has a different diameter. Thus, the power of the drive motor 24 is reduced by the reduction gears 22 and 23 and is then transmitted to the driving gear 20. The microswitch 18 is mounted in the recess 17 of the mounting seat 14 and is electrically connected with the drive motor 24 of the reduction transmission device 2.

The slide 30 is movable in the receiving chamber 15 of the mounting seat 14 and partially protrudes outward from an open bottom of the housing 10. The aperture 36 of the slide 30 allows passage of the driving shaft 21, so that the slide 30 is movable about the driving shaft 21. The slide 30 has a top provided with a flange 34 and a bushing 35. The flange 34 of the slide 30 has an interior provided with a receiving space 33 communicating with the aperture 36. The slide 30 has a periphery provided with a contact 31 that is movable to touch the microswitch 18 to stop operation of the drive motor 24 of the reduction transmission device 2.

The follower 40 is received in the receiving space 33 of the flange 34 of the slide 30 and has a first end provided with a first hole 41 mounted on the bushing 35 of the slide 30 and a second end provided with a second hole 42 mounted on the cam 52. The washer 46 is disposed between the housing 10 and the metallic plate 47 and partially protrudes outward from the open bottom of the housing 10. The washer 46 has a surface provided with an elongate passage to allow passage of the driving shaft 21, so that the washer 46 is movable about the driving shaft 21. The metallic plate 47 protrudes outward from the open bottom of the housing 10. The metallic plate 47 is limited by the stop plate 32. Thus, the metallic plate 47 protects the housing 10 from being scratched by a can due to a rubbing action between the housing 10 and the can. The driving shaft 21 in turn extends through the metallic plate 47, the washer 46, the slide 30, the follower 40, the third driven gear 50 and the mounting seat 14 of the housing 10.

The cutting wheel 44 protrudes outward from the open bottom of the housing 10. The cutting wheel 44 is rotated by the driving shaft 21 which is rotated by the driving gear 20. The idling wheel 43 is mounted on the washer 46 by a fastener 45 and is movable in concert with the washer 46. The idling wheel 43 protrudes outward from the open bottom of the housing 10.

The second driven gear 70 has a periphery provided with a slit 73. The second driven gear 70 has a surface provided with an arcuate guiding slot 72. The first driven gear 60 has a surface provided with a protrusion 66 mounted in the guiding slot 72 of the second driven gear 70. Thus, when the first driven gear 60 is rotated by the driving gear 20, the protrusion 66 of the first driven gear 60 is movable in the guiding slot 72 of the second driven gear 70 to drive and rotate the second driven gear 70 and to compress the torsion spring 64, so that the torsion spring 64 stores a restoring force. The torsion spring 64 is secured on a central portion of the first driven gear 60 and has a distal end provided with a leg 65 inserted into the slit 73 of the second driven gear 70.

The third driven gear 50 partially protrudes outward from the opening 16 of the mounting seat 14 to mesh with the second driven gear 70. Thus, when the third driven gear 50 is rotated by the second driven gear 70, the cam 52 is movable in the aperture 36 of the slide 30 to move the slide 30 which moves the washer 46 which moves the idling wheel 43, so that the idling wheel 43 is movable relative to the cutting wheel 44.

The can opener further comprises a battery receiver 11 mounted on an open top of the housing 10 to receive a plurality of batteries which supply an electric power to the drive motor 24 of the reduction transmission device 2, a lid 12 removably mounted on the open top of the housing 10 to cover the battery receiver 11, a control switch 26 mounted on the battery receiver 11 and electrically connected between the batteries of the battery receiver 11 and the drive motor 24 of the reduction transmission device 2, and a push button 13 movably mounted on the battery receiver 11 and movable to press the control switch 26 to control operation of the drive motor 24 of the reduction transmission device 2. The push button 13 protrudes outward from an exposing slot of the lid 12.

Figure 2:
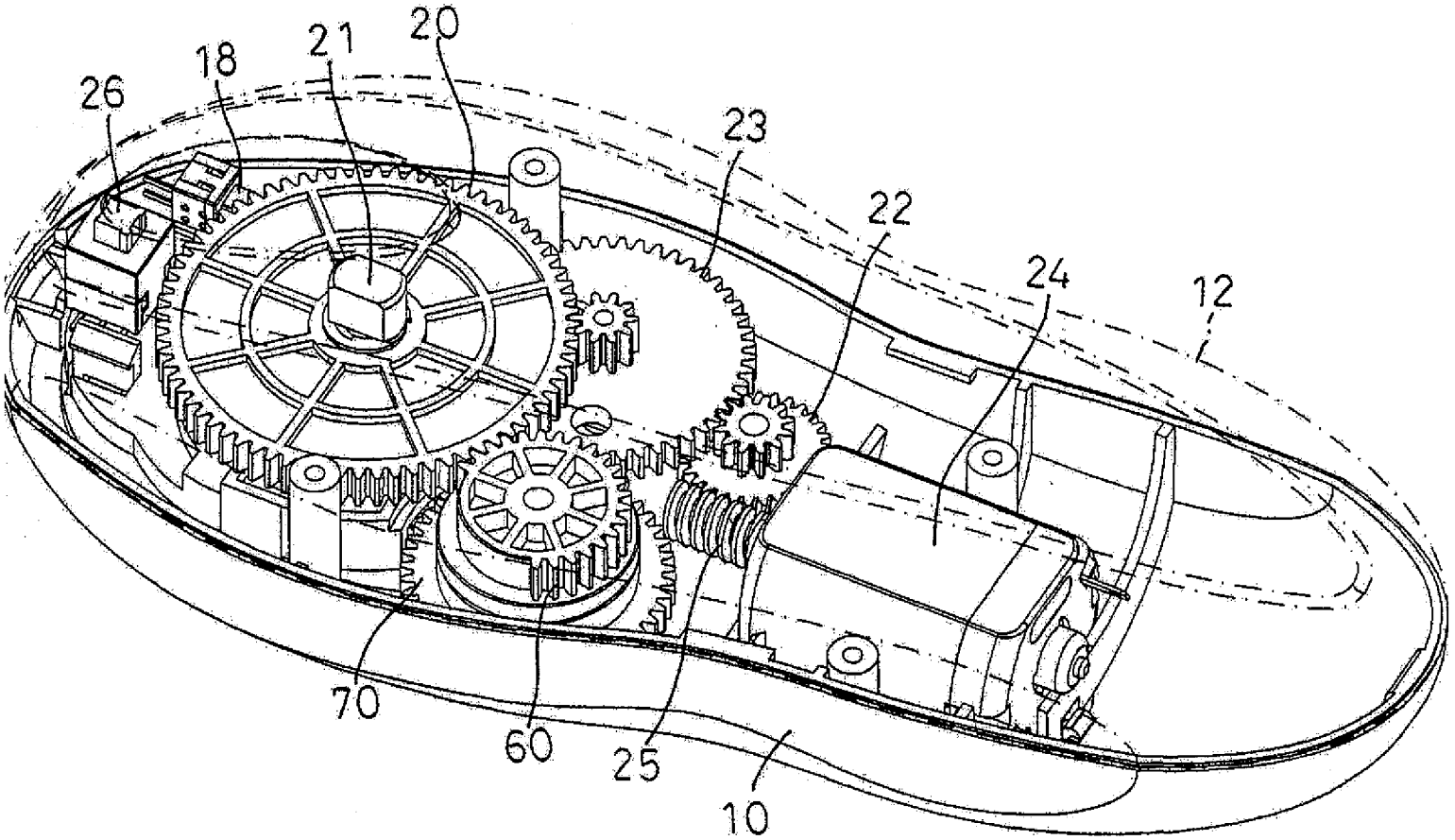
FIG. 2 is a perspective top broken view of a can opener in accordance with the preferred embodiment of the present invention.
Figure 3:
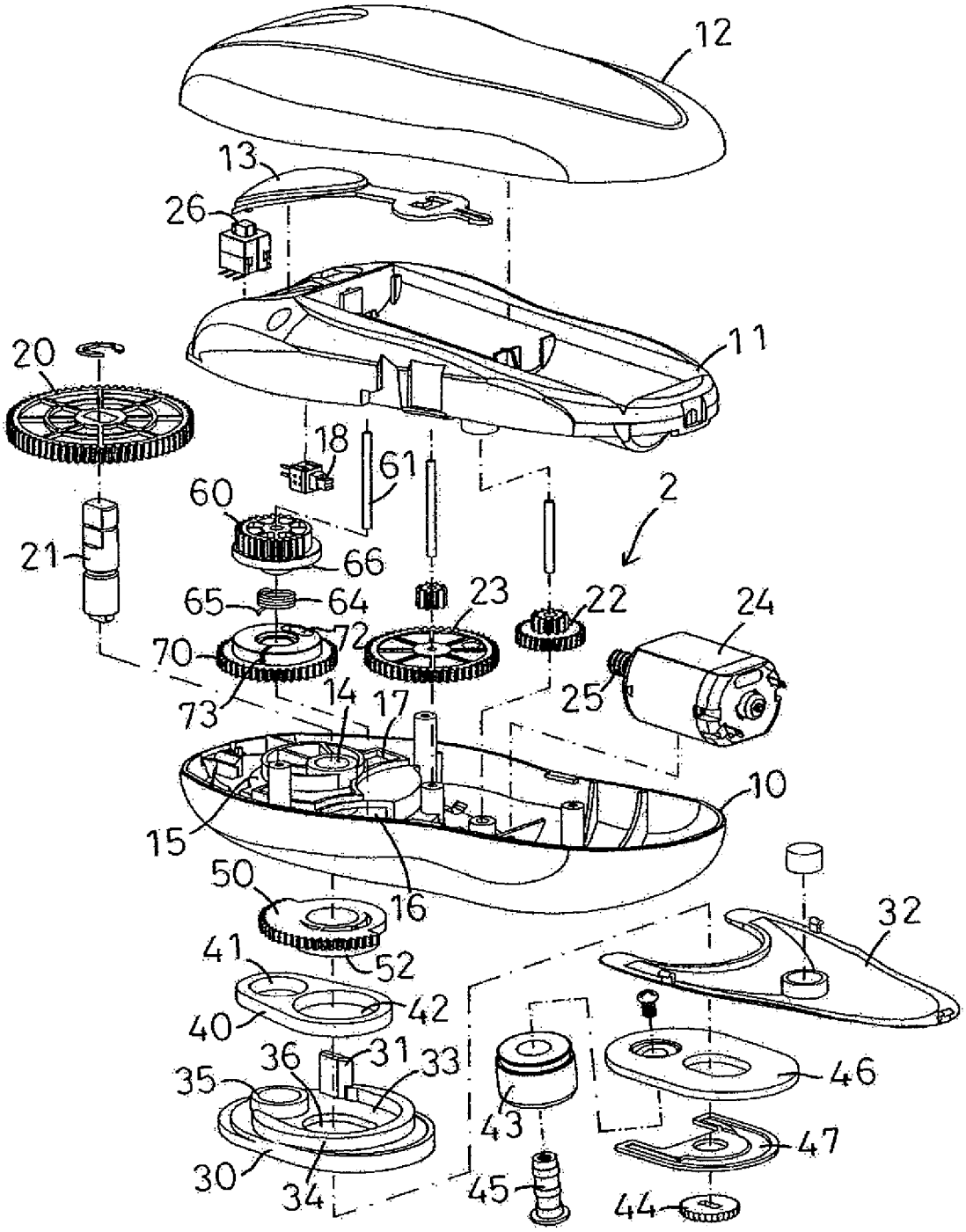
FIG. 3 is an exploded perspective view of the can opener as shown in FIG. 2.
Figure 4:
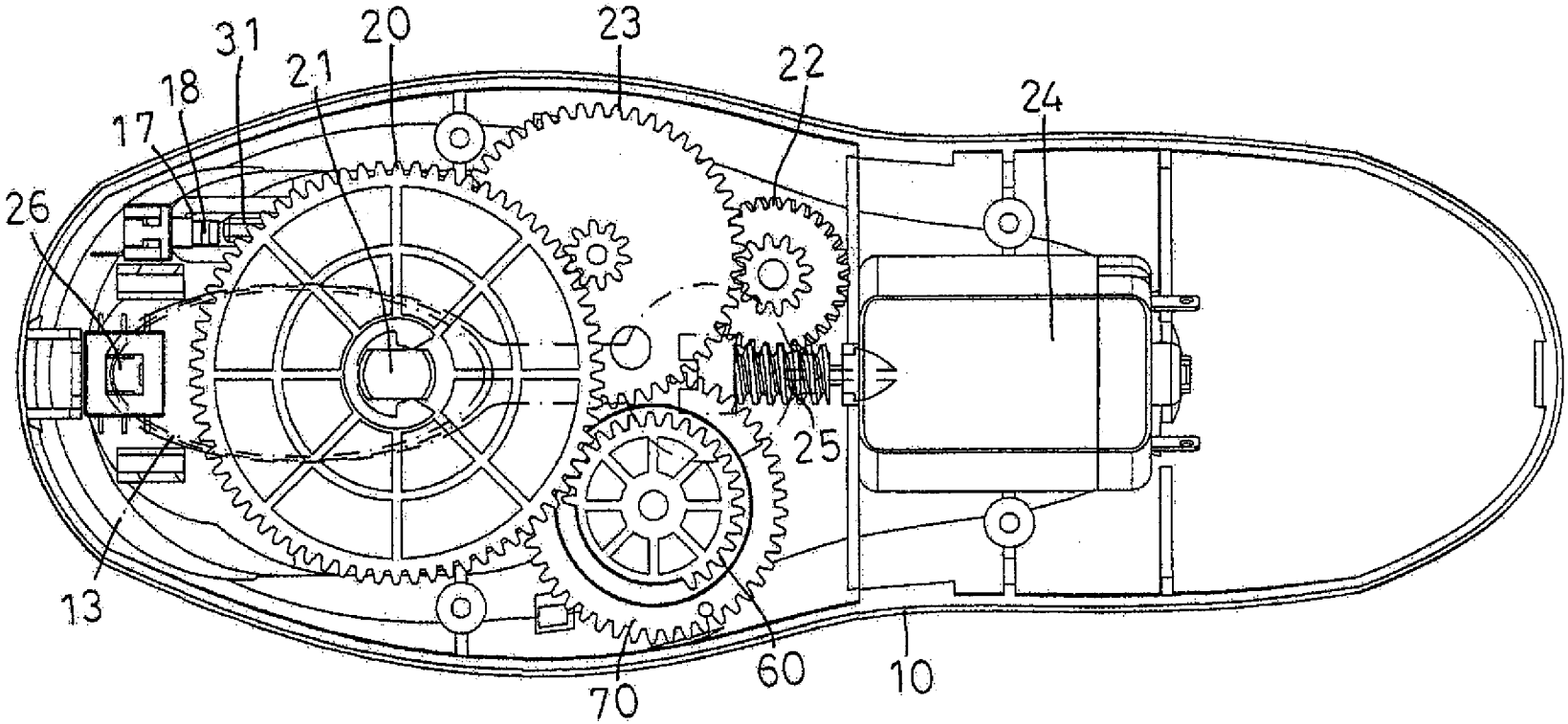
FIG. 4 is a top view of the can opener as shown in FIG. 2.
Figure 5:
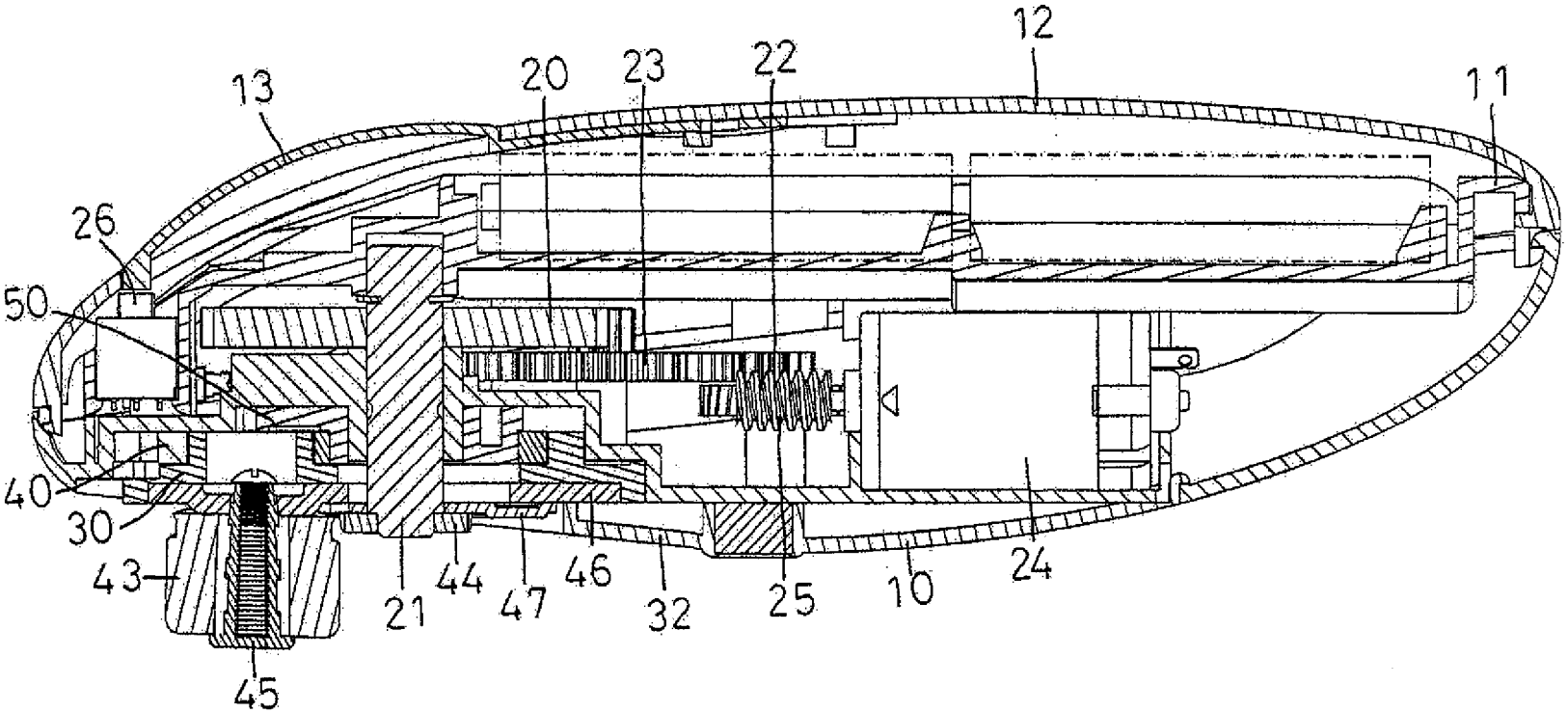
FIG. 5 is a front cross-sectional view of the can opener as shown in FIG. 2.

In operation, referring to FIGS. 4 and 5 with reference to FIGS. 1-3, when the can opener is used to open the lid of a can, the rim of the lid is inserted into a gap between the idling wheel 43 and the cutting wheel 44 of the can opener. When the push button 13 is pressed, the control switch 26 is driven to start the drive motor 24 which rotates the worm 25 which rotates the reduction gears 22 and 23 which rotate the driving gear 20 which rotates the driving shaft 21 which rotates the cutting wheel 44, so that the cutting wheel 44 is rotated. At the same time, when the driving gear 20 is rotated, the first driven gear 60 is rotated by the driving gear 20, and the protrusion 66 of the first driven gear 60 is moved in the guiding slot 72 of the second driven gear 70 to drive and rotate the second driven gear 70 and to compress the torsion spring 64, so that the torsion spring 64 stores a restoring force. In such a manner, the first driven gear 60 drives the second driven gear 70 which rotates the third driven gear 50 which rotates the cam 52 which drives the follower 40 which drives and moves the slide 30 which moves the washer 46 which moves the idling wheel 43 so that the idling wheel 43 is moved toward the cutting wheel 44 to clamp the rim of the lid between the idling wheel 43 and the cutting wheel 44 of the can opener. Then, the rim of the lid is clamped between the idling wheel 43 and the cutting wheel 44, and the cutting wheel 44 is rotated successively, so that the idling wheel 43 and the cutting wheel 44 are moved along the rim of the lid to perform a circular motion about the center of the can to press and cut the rim of the lid and to separate the lid from the can.

After the circular motion of the idling wheel 43 and the cutting wheel 44 is finished, the lid is detached from the can and is attracted magnetically by a magnet mounted on the bottom of the housing 10. At the same time, the second driven gear 70 is driven by the restoring force of the torsion spring 64 to rotate in the reverse direction. In such a manner, the third driven gear 50 is driven by the second driven gear 70 and is rotated in the reverse direction. Thus, the slide 30 is moved in the opposite direction, and the idling wheel 43 is moved to space from the cutting wheel 44. When the contact 31 of the slide 30 is moved to touch the microswitch 18, the microswitch 18 is operated to stop operation of the drive motor 24 of the reduction transmission device 2, so that the can opener stops operating automatically. Thus, when the can opener is taken away from the can, the lid is carried by the magnet of the housing 10, so that the lid is removed from the can.

Accordingly, the can opener separates the lid from the can to open the can automatically to save the user's energy, so that the user does not need to apply any force to open the can. In addition, the can opener is revolved along the rim of the lid to separate the lid from the can and stops operating when the lid is separated from the can, so that the user does not need to hold the can and the can opener during the opening process, thereby facilitating the user operating the can opener to open the can. Further, the lid is directly separated from the can after the can opener finishes a circular motion, so that the can is opened easily and quickly. Further, the rim of the lid is cut by the cutting wheel 44 smoothly without producing sharp burs, so that the rim of the lid will not cut the user after the lid is removed from the can to protect the user's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A can opener, comprising:

a housing having an interior provided with a mounting seat;

a driving gear rotatably mounted on the mounting seat of the housing;

a reduction transmission device mounted in the housing and connected with the driving gear to drive the driving gear, with the reduction transmission device including a drive motor;

a cutting wheel rotatably mounted relative to the housing and rotated in concert with the driving gear;

a slide movably mounted on the mounting seat of the housing and having a surface provided with an aperture;

a washer secured on a bottom of the slide to move in concert with the slide;

an idling wheel rotatably mounted on the washer and movable relative to the cutting wheel;

a first driven gear rotatably mounted in the housing and meshing with the driving gear;

a second driven gear rotatably mounted in the housing;

a torsion spring biased between the first driven gear and the second driven gear to connect the first driven gear and the second driven gear;

a third driven gear rotatably mounted in the housing and meshing with the second driven gear; and a cam mounted on and rotated by the third driven gear and received in the aperture of the slide to move the slide relative to the cutting wheel;

wherein the second driven gear has a surface provided with an arcuate guiding slot;

the first driven gear has a surface provided with a protrusion mounted in the guiding slot of the second driven gear; and when the first driven gear is rotated by the driving gear, the protrusion of the first driven gear is movable in the guiding slot of the second driven gear to drive and rotate the second driven gear and to compress the torsion spring so that the torsion spring stores a restoring force.

2. The can opener of claim 1, further comprising a follower mounted between the third driven gear and the slide to move in concert with the slide; wherein:

the mounting seat of the housing has an interior provided with a receiving chamber for mounting the third driven gear, the follower and the slide;

the slide is movable in the receiving chamber of the mounting seat;

the slide has a top provided with a flange and a bushing;

the flange of the slide has an interior provided with a receiving space communicating with the aperture;

the follower is received in the receiving space of the flange of the slide and has a first end provided with a first hole mounted on the bushing of the slide and a second end provided with a second hole mounted on the cam;

the receiving chamber of the mounting seat has a sidewall provided with an opening;

the third driven gear partially protrudes outward from the opening of the mounting seat to mesh with the second driven gear;

when the third driven gear is rotated by the second driven gear, the cam is movable in the aperture of the slide to move the slide which moves the washer which moves the idling wheel so that the idling wheel is movable relative to the cutting wheel;

the reduction transmission device includes intermeshing first and second reduction gears, wherein the first reduction gear meshes with the driving gear to drive the driving gear, with the drive motor connected with the second reduction gear to drive the first and second reduction gears;

the power of the drive motor is reduced by the first and second reduction gears and is transmitted to the driving gear;

the idling wheel is mounted on the washer by a fastener and is movable in concert with the washer;

the second driven gear has a periphery provided with a slit; and the torsion spring is secured on a central portion of the first driven gear and has a distal end provided with a leg inserted into the slit of the second driven gear.

3. The can opener of claim 1, further comprising:

a stop plate mounted on the housing and abutting the bottom of the slide to attach the slide to the housing;

a driving shaft rotatably mounted in the housing and having a first end connected with the driving gear and a second end connected with the cutting wheel; and a spindle mounted in the housing and extended through the first driven gear and the second driven gear to support the first driven gear and the second driven gear.

4. The can opener of claim 1, further comprising:

a battery receiver mounted on an open top of the housing to receive a plurality of batteries which supply an electric power to the drive motor of the reduction transmission device;

a lid removably mounted on the open top of the housing to cover the battery receiver;

a control switch mounted on the battery receiver and electrically connected between the plurality of batteries of the battery receiver and the drive motor of the reduction transmission device; and a push button movably mounted on the battery receiver and movable to press the control switch to control operation of the drive motor of the reduction transmission device;

wherein the push button protrudes outward from an exposing slot of the lid.

5. The can opener of claim 1, wherein:

the mounting seat of the housing has a surface provided with an elongate recess;

the can opener further comprises a microswitch mounted on the mounting seat of the housing;

the microswitch is mounted in the recess of the mounting seat and is electrically connected with the drive motor of the reduction transmission device; and the slide has a periphery provided with a contact that is movable to touch the microswitch so as to stop operation of the drive motor of the reduction transmission device.

6. The can opener of claim 1, further comprising a metallic plate mounted on the driving shaft and disposed between the washer and the cutting wheel; wherein the metallic plate protects the housing from being scratched by a can due to a rubbing action between the housing and the can.

* * * * *